US006418690B1

(12) United States Patent
Wheatley et al.

(10) Patent No.: US 6,418,690 B1
(45) Date of Patent: Jul. 16, 2002

(54) OUTDOOR DECK MATERIAL

(75) Inventors: Charles E. Wheatley, Cincinnati, OH (US); Colin G. Carr, Grand Rapids, MI (US)

(73) Assignees: Chalres E. Wheatley, Cincinnati, OH (US); James A. Mitchell, Grand Rapids, MI (US)

( * ) Notice: Subject to any disclaimer, the term of this patent is extended or adjusted under 35 U.S.C. 154(b) by 0 days.

(21) Appl. No.: 09/463,641

(22) PCT Filed: Jul. 31, 1998

(86) PCT No.: PCT/US98/15965

§ 371 (c)(1),
(2), (4) Date: Jan. 27, 2000

(87) PCT Pub. No.: WO99/06645

PCT Pub. Date: Feb. 11, 1999

Related U.S. Application Data

(60) Provisional application No. 60/054,360, filed on Jul. 31, 1997.

(51) Int. Cl.[7] ..... E04B 5/08

(52) U.S. Cl. ..... 52/480; 52/403.1; 52/177; 52/387; 52/388; 52/391; 52/392

(58) Field of Search ..... 52/177, 387, 388, 52/390–392, 403.1, 480, 718.06

(56) References Cited

U.S. PATENT DOCUMENTS

| | | | | |
|---|---|---|---|---|
| 153,599 A | | 7/1874 | Owen | |
| RE7,293 E | | 9/1876 | Groocock | |
| 1,854,512 A | | 4/1932 | Herpes | |
| 2,091,476 A | | 8/1937 | Elmendorf | |
| 2,165,788 A | | 7/1939 | Elmendorf | |
| 3,077,059 A | * | 2/1963 | Stout | |
| 3,279,138 A | * | 10/1966 | Dittmar | |
| D207,200 S | | 3/1967 | Scheller | |
| 4,694,627 A | * | 9/1987 | Omholt | 52/390 |
| 4,741,065 A | * | 5/1988 | Parkins | 15/217 |
| 4,828,896 A | * | 5/1989 | Fanti | 428/67 |
| 5,213,861 A | | 5/1993 | Severson et al. | |
| 5,238,721 A | * | 8/1993 | Nakazawa | 428/44 |
| 5,303,526 A | | 4/1994 | Niese | |
| 5,369,927 A | | 12/1994 | Counihan | |
| 5,722,211 A | | 3/1998 | Goldschmidt | |
| 5,778,621 A | | 7/1998 | Randjelovic | |
| 5,941,047 A | * | 8/1999 | Johansson | 52/747.1 |
| 6,050,040 A | * | 4/2000 | Jones | 52/390 |
| 6,141,931 A | * | 11/2000 | Simmons | 52/480 |

FOREIGN PATENT DOCUMENTS

| | | |
|---|---|---|
| DE | 935863 | 12/1955 |
| DE | 3217737 | 5/1982 |
| FR | 930174 | 1/1948 |
| FR | 1097009 | 6/1955 |
| FR | 1133226 | 3/1957 |
| FR | 1143692 | 10/1957 |
| GB | 828823 | 2/1960 |
| JP | 485401 | 3/1992 |

* cited by examiner

*Primary Examiner*—Carl D. Friedman
*Assistant Examiner*—Yvonne M. Horton
(74) *Attorney, Agent, or Firm*—Price, Heneveld, Cooper, DeWitt & Litton

(57) ABSTRACT

The specification discloses an outdoor deck surface unit in which a plurality of boards, suitable for outdoor use, are secured to an underlying substrate. The deck units cover an area of from about 2 to about 6 square feet, such that they are large enough that an entire deck surface can be created relatively quickly, but are sufficiently small that a deck surface unit can be readily lifted, moved, placed and handled by a single individual.

32 Claims, 3 Drawing Sheets

OUTDOOR DECK MATERIAL

Applicant claims priority to U.S. provisional patent application Ser. No. 60/054,360, filed Jul. 13, 1997, and to International Patent Application No. PCT/US98/15965, filed Jul. 13, 1998.

BACKGROUND OF THE INVENTION

The present invention relates to outdoor decks. It has become popular to build attractive, outdoor wooden decks. Often they are attached to a home, but sometimes they are built to stand alone. They are typically made from lumber which has been treated to resist weathering.

While such decks are attractive, they are expensive to build. One typically must build a supporting framework, and then nail top boards to the framework. Even a relatively small deck may cost $1,500–$2,500 to add to a home, if the work is done professionally. If the work is done as a "do-it-yourself" project, the lumber is still quite expensive, and the process of building the deck is very time-consuming.

SUMMARY OF THE INVENTION

The present invention comprises relatively small outdoor deck surface units. which can be easily handled by a "do-it-yourselfer," and which can be easily placed on a cement slab, some other support or even directly on the ground, to create an attractive outdoor deck, quickly and easily. Each unit comprises a plurality of boards arranged in a desired pattern and secured to an underlying substrate. Each unit is sufficiently large that an entire deck surface can be created relatively quickly, but is sufficiently small that each unit can readily be handled by a "do-it-yourself" deck builder without undue hardship.

As a result of this invention. an unsightly concrete slab, a prepared layer of sand or dirt or even an old unsightly wooden deck can instantly be converted into an attractive deck by one simply placing a plurality of individual decking surface units in an adjacent fashion onto the unsightly surface.

These and other objects, advantages and features of the invention will be more fully understood and appreciated by reference to the written specification and appended drawings.

BRIEF DESCRIPTION OF THE DRAWINGS

FIG. 4 is a perspective view of an alternative embodiment deck with the individuals surface units arranged in a different manner;

DETAILED DESCRIPTION OF PREFERRED EMBODIMENT

Figure 1:
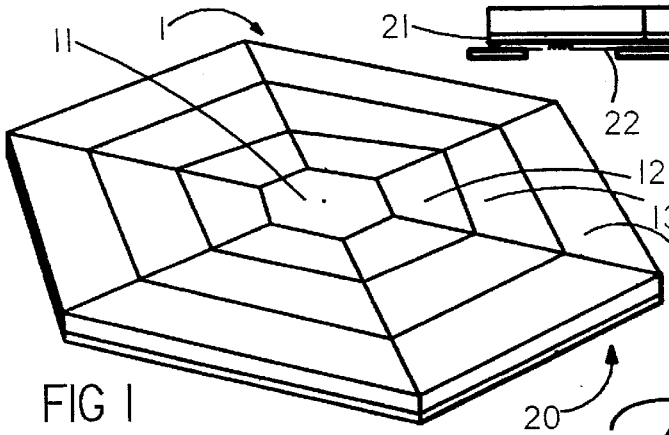
FIG. 1 comprises a perspective view of a deck surface unit made in accordance with the present invention.
Figure 3:
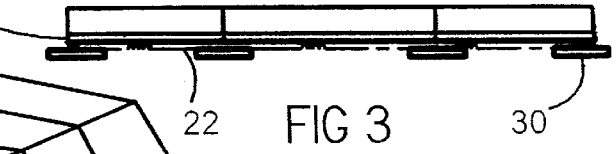
FIG. 3 is a side elevational view of the deck surface unit.
Figure 2:
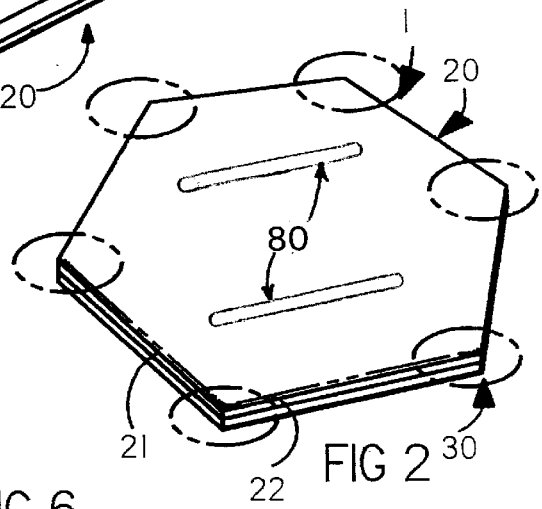
FIG. 2 is a perspective view of the reverse side of the surface unit from the side shown in FIG. 1 with a single joining unit also being shown at one corner of the deck surface unity.
Figure 4:
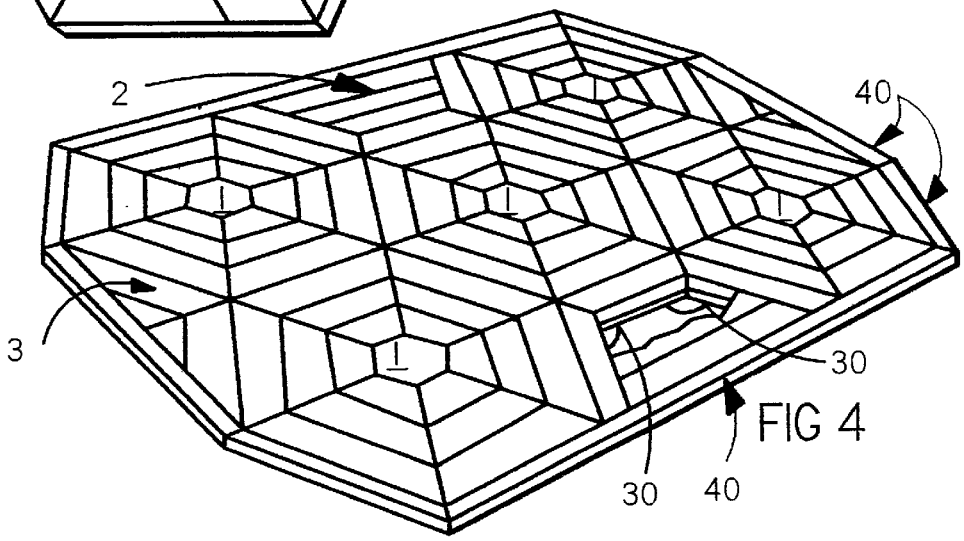
FIG. 4 is a perspective view of an assembled deck, bounded by an edging trim strip.

In the preferred embodiment, a plurality of individual weather-treated boards 11–11, arranged in a predetermined pattern, are secured to an underlying substrate member 20. By arranging units 1 in a side-by-side fashion, one can create an entire deck surface as shown in FIG. 4. Preferably, adjacent deck units 1 are kept from moving apart either by tacking a trim strip 40 around the perimeter of the arranged units (FIG. 4), or by underlying each of the adjacent units along adjacent side edges or corners with a small joining pad 30 (FIGS. 2 and 3), or by underlying several or all of the units with one or more pieces of double-faced adhesive 80 (FIG. 2) or some combination of the foregoing. Another option is to underlie at least the perimeter units with double-faced tape 80. Units, similarly made, of different configurations, e.g. units 2 and 3 in FIG. 4, are used to fill in small spaces left by the arrangement of adjacent decking units.

Each of the boards 11–14 is preferably weather treated lumber to be resistant to outdoor conditions. The boards can be treated during manufacture, but units 1 can also be sold without treatment, leaving treatment to the purchaser. It is preferably of sufficient thickness to resist warpage. Each individual boards 11–14 are preferably of sufficiently small area that the effects of any warpage on individual boards are less likely to be noticed. Most preferably, the individual boards, other than centerpiece 11, are cut from ⅝ inch by 4 inch boards, which in other words, have a thickness of about 1 inch and a width of about 3½ inches. In the pattern shown in deck surface unit 1, centerpiece 11 has to be cut from a somewhat wider board, but also of ⅝ inch nominal thickness. If 1 inch thick boards are used, the final thickness of the boards is about ¾ of an inch.

In an alternative embodiment, the individual boards 11–15 can be molded of a weather resistant polymeric material. Structural foam polyethylene or polypropylene might be used. UV stabilizers would be incorporated. ABS and glass fiber reinforced urethanes and/or polyisocyanurates might also be used. The relatively small size of the individual boards 11–15 helps to minimize heat shrink and weather warpage problems. Ceramic or regular or foam concrete might also be used to make boards 11–15.

Each deck surface unit 1 is sufficiently large that it covers a significant area, but is sufficiently small that a unit can readily be lifted, moved, placed and handled by a single individual. Preferably, each unit covers an area of at least about 2 square feet and no more than about 6 feet. More preferably, the area covered by each unit is between 3 and 5 feet. Unit 1 as shown in FIGS. 1–4 is a hexagon which is 15.5 inches on each side, and therefore covers approximately 4.36 square feet. Preferred embodiment unit 1 comprises a hexagonally-shaped centerpiece 11, having a trapezoidally-shaped board 12 adjacent each edge of hexagon 11. Each board 12 has a larger trapezoidally-shaped board 13 adjacent it, and each board 13 has a larger trapezoidally-shaped board 14 adjacent it.

Substrate member 20 is preferably flexible and, in one embodiment, slightly cushiony to absorb irregularities in an underlying surface. It also preferably has a floor engaging surface which affords some frictional resistance against deck surface unit slippage during use. In preferred embodiment unit 1, substrate 20 comprises a hexagonally-shaped piece of outdoor carpeting having a polymeric backing surface 21 with a nap layer 22 projecting therefrom. The polymeric backing is preferably a rubbery polymer backing. Boards 11–15 are preferably glued to the polymeric, preferably rubbery, backing surface 21, with nap 22 facing away from the boards. Any adhesive which will resist the conditions of outdoor use and adhere wood to a rubbery polymeric material may be used. It has been found that a polyethylene hot-melt is a satisfactory adhesive, though a preferred adhesive is a moisture cured polyurethane adhesive.

An alternative to using outdoor carpeting for substrate member 20 is to use "geo fabric" that includes a "fuzzy surface" on one side. While less cushiony than outdoorcarpet, it is economically less expensive and easier to cut so that individual units 1 can be cut. Geo fabric is woven from a very strong, polymeric, narrow ribbon. Some geo fabric is available with a "fuzzy surface" on one side. This is the type of geo fabric that is preferred for use as substrate 20 in the present invention. The individual boards 11–14 are adhered to the smooth side of the geo fabric, such that the fuzzy surface acts as a friction surface to prevent the individual decking units 1 from sliding, or at least to minimize such slippage. Geo fabric is currently believed to be the best mode backing A jute mat, polyester mat, polyethylene mat, polypropylene mat or other flexible weather resistant substrate, for example of the type used in quality indoor-outdoor carpet backings might be used. Materials which deteriorate relatively quickly in the elements, including some foam rubber carpet backing materials, are preferably avoided, in order to have a quality product.

Joining units 30 are simply small area circles of a soft, fairly high friction, rubbery material. Each circle is very thin, and has a relatively small area, just sufficient to engage a portion of each of two or three adjacent units 1. Double-faced tape or bead 80 (FIG. 2) can be used in addition to or in place of units 30. A preferred double-faced adhesive material is the tacky polyvinylbutyrate bead material used in the auto industry to seal the perimeter of windshields. This material comes in a 3⁄16 inch diameter bead, rolled up with a silicone release paper tape. It could be applied at the point of manufacture, but is preferably sold with units 1 for application in situ by the installer. That way the bead compresses under unit 1 in conformity with irregularities in the underlying surface.

As arranged in FIG. 4, each deck unit 1 abuts an adjacent deck unit 1 along a side edge. This leaves two different types of gaps at the perimeter of an assembled deck surface, as shown in FIG. 4. One is of a trapezoidal configuration, which can be filled by a trapezoidally-shaped unit 2. The other is triangular, and can be filled by a triangular-shaped unit 3. As mentioned above, a trim strip 40 is then tacked to the perimeter of the assembled deck surface to help hold it all together. In addition, joining members 30 are located at each corner of the adjacent units 1. The specially shaped perimeter units 2 and 3 may also be adhered to a rather stiff, thin plastic substrate which projects from the inside edge of the perimeter unit underneath adjacent larger units. This helps prevent the perimeter units from flipping if a person steps on the outside edge, it also helps to hold the smaller perimeter units in place.

Figure 5:
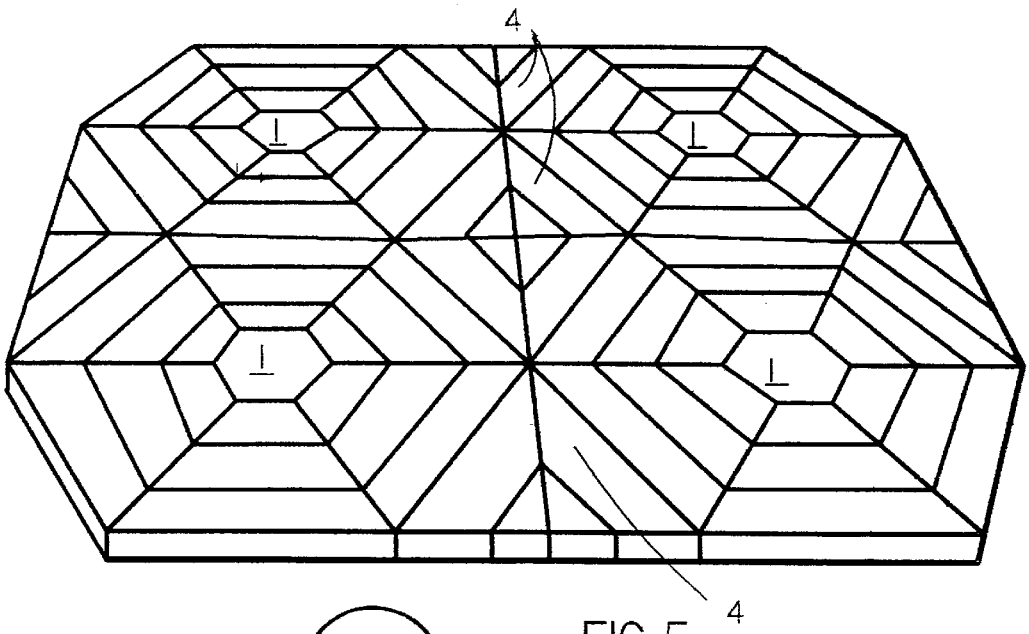

FIG. 5 shows an alternative arrangement of units 1, wherein some are arranged side-by-side, while others are arranged point-to-point. This leaves diamond-shaped openings in the interior of the deck surface, and triangular-shaped openings along each edge. By providing a plurality of triangular-shaped or "half diamond" shaped units 4 a pair of such units arranged back-to-back can take care of the gaps left in the interior of the deck surface, while one of such units can take of a triangular opening along the edge.

Figure 6:
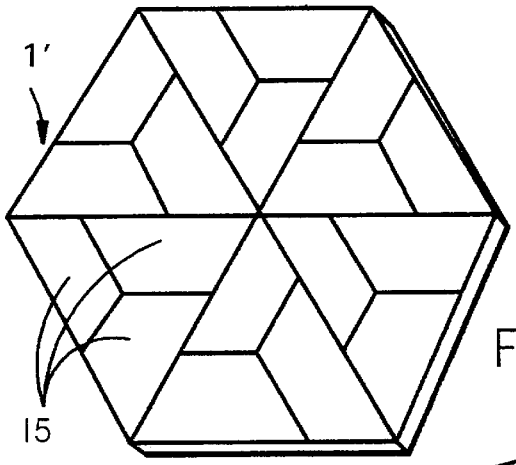
FIG. 6 is a top perspective view of an alternative embodiment individual decking unit of a different pattern.
Figure 7:
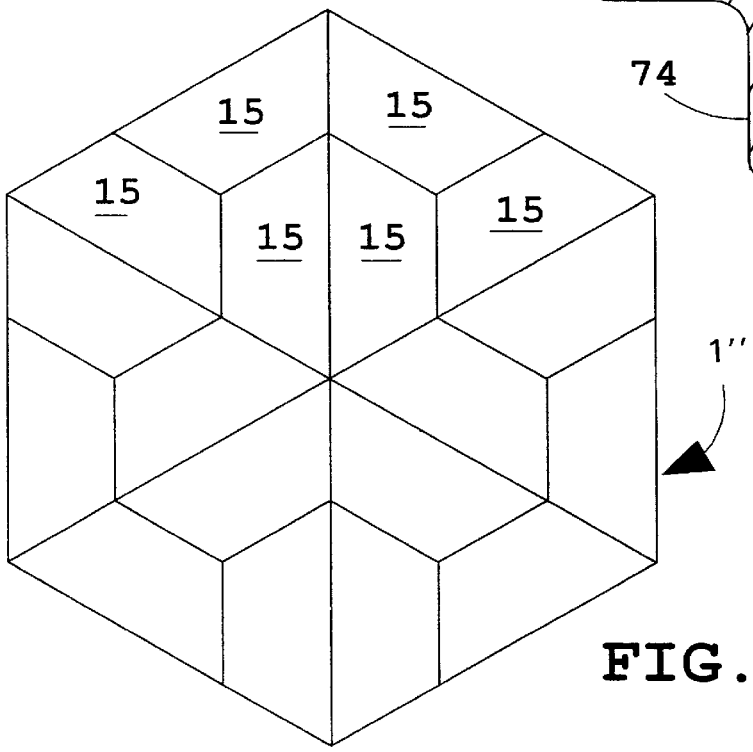
FIG. 7 is a plan view of yet an alternative embodiment deck surface unit.

FIG. 6 shows an alternative embodiment hexagonal-shaped surface unit 1' made up of boards 15 which are all of the same size and shape. Each board 15 is cut as a trapezoid. When cut from board which is 3½ inches wide, each trapezoid must have a top edge which is 4 inches long and a bottom edge which is 8 inches long. The diagonal edges are also 4 inches long. A deck surface unit 1' is comprised of six sections, with three boards 15 in each section. When each board is 3½ inches wide, the length of each side of the resulting hexagon is 12 inches, and the area covered by deck unit 1' is about 2.6 square feet. FIG. 7 shows an alternative embodiment deck surface unit 1" which is made out of precisely the same trapezoidally-shaped units 15 as is deck surface unit 1' of FIG. 6. The boards 15 are arranged in a slightly different pattern, however. Yet, the length of each of the hexagonal edges and the area covered by deck unit 1" are the same as for deck unit 1'.

One advantage to the alternative embodiment deck units 1' and 1" is that they can be made from individual boards which have identical dimensions. This makes the job of cutting and handling during manufacturing much easier. A second important advantage is that individual deck units 1' and 1" can be cut in half, or even in individual triangular-shaped sections, by simply cutting through substrate member 20 with a knife (this can also be done with embodiment 1, if center board 11 is made in two equal halves). This will be useful when arranging perimeter pieces. Yet another advantage to deck surface units 1' and 1" is that their overall dimensions are such that four of them fit on a standard 36×48 inch pallet. Using the same trapezoidally-shaped units 15 adhered to the flexible geo fabric substrate is currently believed to be the best mode for practicing the invention.

Figure 8:
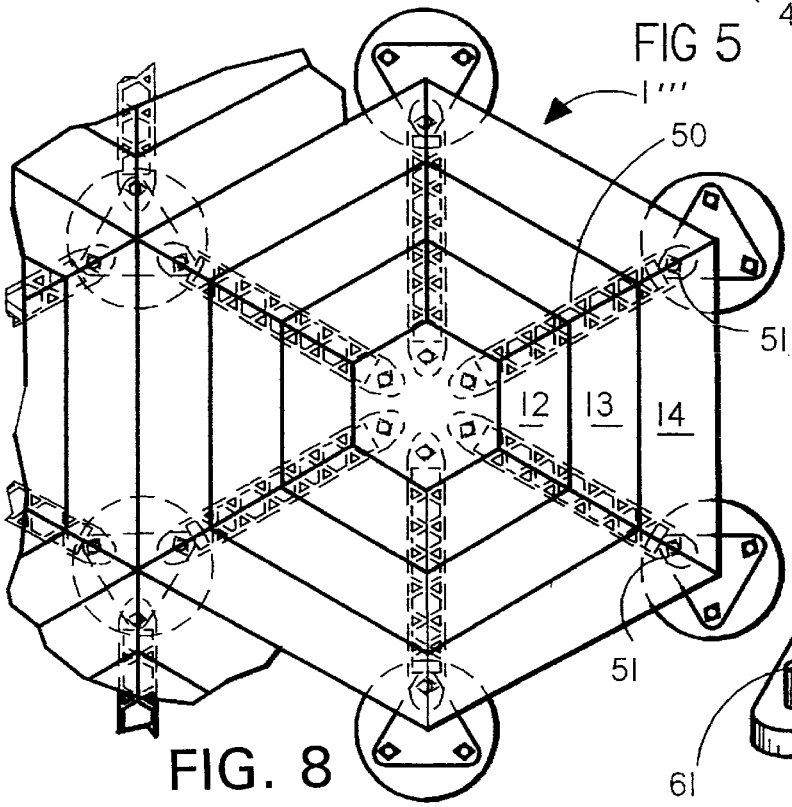
FIG. 8 is a top plan view of an alternative embodiment deck surface unit, with fragmentary portions of several adjacent units also being shown in plan view, and with substrate members shown in phantom.
Figure 9:
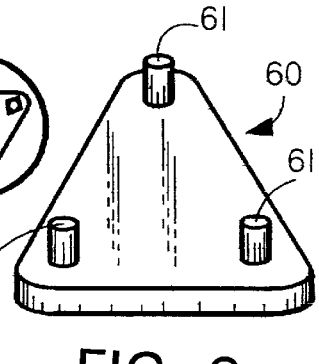
FIG. 9 is a perspective view of an alternative embodiment joining member.

In an alternative embodiment deck surface unit 1''' (FIG. 8), the individual boards 11–14 are secured to a plurality of separate substrate members 50, each comprising a separate molded plastic rib. Each of boards 11–14 are tacked or glued to the ribs 50. In the hexagon shown in FIG. 8, each rib extends radially outwardly from the center, along the seam between adjacent hex segments. Each rib 50 includes an open socket 51 at each end, which receives the upwardly extending post 61 of a triangularshaped joining member 60 (FIG. 9). Joining member 60 is preferably molded of plastic, preferably the same type of plastic used to make molded ribs 50.

Figure 10:
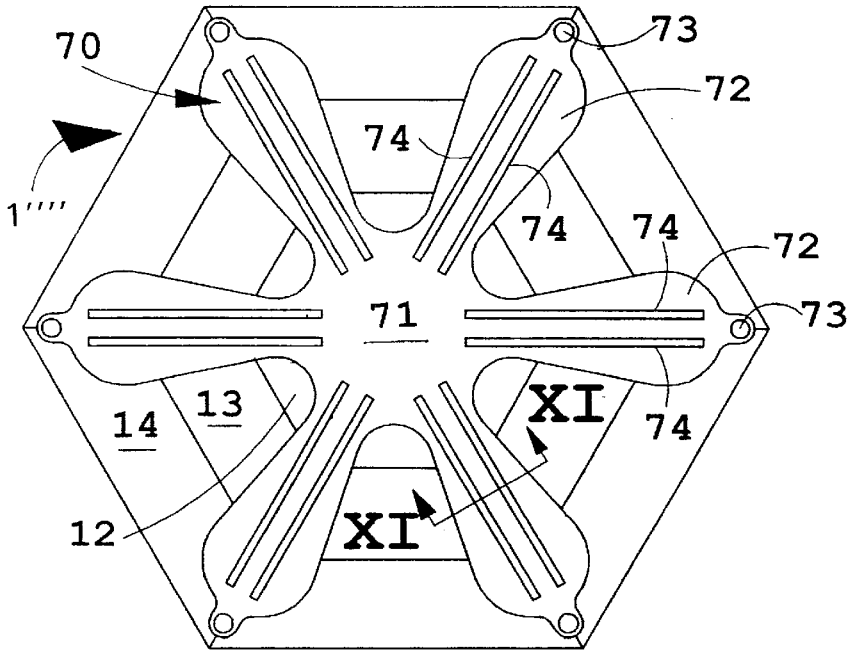
FIG. 10 is a bottom plan view of an alternative embodiment deck surface unit, utilizing a different type of substrate member.
Figure 11:
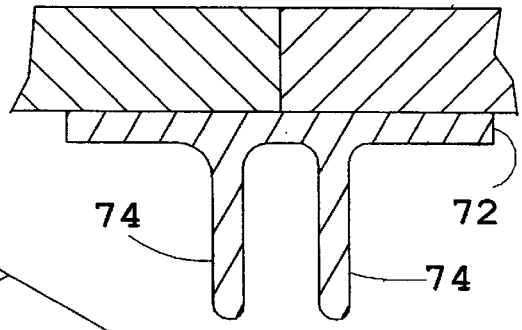
FIG. 11 is a cross-sectional, fragmentary view of the substrate member, taken along plane XI—XI of FIG. 10.

The ribs 50 required for a deck surface unit 1''' can also be molded as a single integral unit, rather than as separate units. FIG. 10 shows an alternative embodiment deck unit 1''' in which the individual boards 11–14 are adhered to an integrally molded substrate 70. Substrate 70 is vacuum formed or injection molded of plastic, and includes a center 71, outwardly radiating arms 72, a joining member receiving aperture 73 at the end of each arm 72, and a pair of downwardly projecting ribs 74 on the bottom of each arm 72. The ribs 74 reinforce arms 72 and also provide a support for deck unit 1''' (FIG. 11).

Using the deck system of the present invention, any individual can make a lovely wood surfaced deck in an afternoon. A plurality of individual surface units can be placed on a concrete slab. Alternatively, one can dig up a patch of grass and smooth a dirt or sand surface to which individual deck surface units 1, 1', 1", 1'" or 1"" can be placed. One could also build a plywood surfaced deck, and then cover the plywood with a plurality of deck surface units. Joining members 30 or 60 are used to help keep adjacent deck units from slipping relative to one another. In addition, a perimeter trim strip can be tacked around the perimeter of the assembled units to help hold them in place. Nails can be nailed directly into the exposed side edges of the perimeter deck units. When outdoor carpet substrate 20 is used, the surface units can be reversed to provide an outdoor carpet surface instead of the wood deck surface appearance. Using a flexible substrate, especially a relatively thin material such as geo fabric, allows the units 1, 1', or 1" to conform somewhat to surface irregularities, and allows the units to be cut into partial units with a knife or the like.

Of course, the above are merely preferred embodiments of the invention. Various changes and alterations can be made without departing from the spirit and broader aspects thereof, as set forth in the following claims, which are to be interpreted according to the principles of patent law, including the doctrine of equivalents.

The invention claimed is:

1. An outdoor deck surface unit comprising:

a substrate support member;

a plurality of separate boards, said plurality of boards being unitized by being secured to said substrate in a desired pattern;

said deck surface unit being sufficiently large that an entire deck surface is created relatively quickly, but being sufficiently small that a deck surface unit is capable of being readily lifted, moved, placed and handled by a single individual;

said substrate support member comprises a top side to which said boards are adhered and an opposite side having a nap surface projecting therefrom.

2. The deck surface unit of claim 1 in which said plurality of separate boards are sufficiently small in area to minimize the effects of warpage on any individual board.

3. The deck surface of claim 2 in which said plurality of separate boards are made of lumber of sufficient thickness to resist warpage.

4. The deck surface unit of claim 3 in which said lumber is treated to be resistant to outdoor conditions.

5. The deck surface unit of claim 1 in which said unit has the shape of a hexagon.

6. The deck surface unit of claim 5 in which said boards include a hexagonally-shaped centerpiece and trapezoidally-shaped boards arranged in rows and extending parallel to the side edges of said centerpiece.

7. The deck unit of claim 5 in which said boards are shaped to define trapezoids of equal dimensions.

8. The deck unit of claim 7 comprising six sections, and three trapezoidally-shaped boards per section.

9. The deck surface unit of claim 1 in which said substrate support member is a flexible member.

10. The deck surface unit of claim 9 in which said substrate support member is sufficiently thick and cushiony to absorb some irregularities in an underlying surface.

11. The deck surface unit of claim 10 in which said substrate support member comprises outdoor carpet.

12. The deck surface unit of claim 1 which covers an area of from about 2 square feet to about 6 square feet.

13. The deck surface unit of claim 12 in which each of said boards is at least about ¾ inch thick.

14. A deck system comprising a plurality of deck surface units in accordance with claim 1.

15. The deck system of claim 14 in which at least some of said deck surface units are held in place by pieces of double-faced tape applied to the undersurface of said substrate.

16. The deck system of claim 15 in which said double-faced tape comprises a tacky, adhesive bead material.

17. The deck system of claim 14 in which said plurality of deck surface units are held in position by a trim member extending around the perimeter edge of said plurality of units.

18. An outdoor deck surface unit comprising:

a substrate support member;

a plurality of separate boards, said plurality of boards being unitized by being secured to said substrate in a desired pattern;

said deck surface unit being sufficiently large that an entire deck surface is created relatively quickly, but being sufficiently small that a deck surface unit is capable of being readily lifted, moved, placed and handled by a single individual;

said substrate comprising a relatively thin fabric layer with a fuzzy layer projecting from one side thereof, said individual boards being adhered to the side of said fabric opposite said fuzzy layer side.

19. The deck surface unit of claim 18 in which said plurality of separate boards are sufficiently small in area to minimize the effects of warpage on any individual board.

20. The deck surface of claim 19 in which said plurality of separate boards are made of lumber of sufficient thickness to resist warpage.

21. The deck surface unit of claim 20 in which said lumber is treated to be resistant to outdoor conditions.

22. The deck surface unit of claim 18 in which said thin layer of fabric comprises geo fabric.

23. The deck surface unit of claim 18 in which said unit has the shape of a hexagon.

24. The deck surface unit of claim 23 in which said boards include a hexagonally-shaped centerpiece and trapezoidally-shaped boards arranged in rows and extending parallel to the side edges of said centerpiece.

25. The deck unit of claim 23 in which said boards are shaped to define trapezoids of equal dimensions.

26. The deck unit of claim 25 comprising six sections, and three trapezoidally-shaped boards per section.

27. The deck surface unit of claim 18 which covers an area of from about 2 square feet to about 6 square feet.

28. The deck surface unit of claim 27 in which each of said boards is at least about ¾ inch thick.

29. A deck system comprising a plurality of deck surface units in accordance with claim 18.

30. The deck system of claim 29 in which at least some of said deck surface units are held in place by pieces of double-faced tape applied to the undersurface of said substrate.

31. The deck system of claim 30 in which said double-faced tape comprises a tacky, adhesive bead material.

32. The deck surface unit of claim 29 which covers an area of from about 2 square feet to about 6 square feet.

* * * * *

UNITED STATES PATENT AND TRADEMARK OFFICE

CERTIFICATE OF CORRECTION

PATENT NO. : 6,418,690 B1
DATED : July 16, 2002
INVENTOR(S) : Charles E. Wheatley and Colin G. Carr It is certified that error appears in the above-identified patent and that said Letters Patent is hereby corrected as shown below:

Title page,
Item [73], Assignees, "Chalres E. Wheatley" should be -- Charles E. Wheatley --.

Column 1,
Line 35, after "invention" delete ".".
Line 57, "Fig. 4" should be -- Fig. 5 --.
Line 58, "individuals" should be -- individual --.
Line 58, after "individual" insert -- deck --.

Column 2,
Line 12, "boards 11-11" should be -- boards 11-14 --.

Column 3,
Line 18, "outdoorcarpet" should be -- outdoor carpet --.

Column 4,
Line 6, after "take" insert -- care --.
Line 48, "triangularshaped" should be -- triangular shaped --.
Lines 56 and 63, "unit 1" should be -- unit'" --.

Signed and Sealed this

Twenty-eighth Day of January, 2003

JAMES E. ROGAN
*Director of the United States Patent and Trademark Office*